US007063815B2

(12) United States Patent
Li et al.

(10) Patent No.: US 7,063,815 B2
(45) Date of Patent: Jun. 20, 2006

(54) PRODUCTION OF COMPOSITE MATERIALS BY POWDER INJECTION MOLDING AND INFILTRATION

(75) Inventors: Qingfa Li, Singapore (SG); Su Xia Zhang, Singapore (SG); Meng Kwong Ho, Singapore (SG)

(73) Assignee: Agency for Science, Technology and Research, Singapore (SG)

( * ) Notice: Subject to any disclaimer, the term of this patent is extended or adjusted under 35 U.S.C. 154(b) by 240 days.

(21) Appl. No.: 10/729,429

(22) Filed: Dec. 5, 2003

(65) Prior Publication Data

US 2005/0123433 A1 Jun. 9, 2005

(51) Int. Cl.
*B22F 3/10* (2006.01)

(52) U.S. Cl. ..... 419/46; 419/47

(58) Field of Classification Search ..... 419/46, 419/47

See application file for complete search history.

(56) References Cited

U.S. PATENT DOCUMENTS

| | | | | |
|---|---|---|---|---|
| 4,140,170 | A * | 2/1979 | Baum | 164/493 |
| 4,327,156 | A * | 4/1982 | Dillon et al. | 428/568 |
| 4,554,218 | A * | 11/1985 | Gardner et al. | 428/567 |
| 4,636,480 | A * | 1/1987 | Hillig | 501/87 |
| 4,769,071 | A | 9/1988 | Klar et al. | |
| 4,777,014 | A * | 10/1988 | Newkirk et al. | 419/12 |
| 5,413,751 | A | 5/1995 | Polese et al. | |
| 5,574,959 | A | 11/1996 | Tsujioka et al. | |
| 5,641,920 | A | 6/1997 | Hens et al. | |
| 5,686,676 | A | 11/1997 | Jech et al. | |
| 5,905,938 | A | 5/1999 | Akiyoshi | |
| 5,950,063 | A | 9/1999 | Hens et al. | |
| 5,963,773 | A | 10/1999 | Yoo et al. | |
| 5,993,731 | A | 11/1999 | Jech et al. | |
| 6,103,392 | A | 8/2000 | Dorfman et al. | |
| 2002/0068005 | A1 | 6/2002 | Meinhardt et al. | |

FOREIGN PATENT DOCUMENTS

JP 10/008110 A2 1/1998

OTHER PUBLICATIONS

Randall M. German, Powder Matallurgy Science (pp. 310-312).

* cited by examiner

*Primary Examiner*—Daniel Jenkins
(74) *Attorney, Agent, or Firm*—Harness, Dickey & Pierce, P.L.C.

(57) ABSTRACT

Metal-metal or metal-ceramic/carbide composite materials are fabricated by combination of powder injection molding and infiltration. This is achieved by first forming a composite system having a matrix component and an infiltrant layer. The matrix component is formed from a metal or ceramic/carbide powder, that is of a higher melting point, admixed with a first binder. The infiltrant layer is formed from a metal powder, that is of a lower melting point, admixed with a second binder. The first and second binders are subsequently removed from the composite system during a debinding process. The composite system is then heated in a sintering furnace to coalesce the matrix component into a matrix phase having a network of interconnected pores, and to effect infiltration of the infiltrant layer into these pores to form the composite material of the present invention.

16 Claims, 1 Drawing Sheet

PRODUCTION OF COMPOSITE MATERIALS BY POWDER INJECTION MOLDING AND INFILTRATION

BACKGROUND OF THE INVENTION

1. Field of Invention

The present invention relates generally to a method for producing a composite material comprising a matrix phase and a dispersed phase, in particular a metal-metal or a metal-ceramic composite material, such as a tungsten-copper composite material, and the material produced thereby.

2. Description of Related Art

Metal-metal composite and metal-ceramic composite materials are popular as special materials in plant apparatus and equipment construction due to their enhanced mechanical, electrical and thermal properties. In electrical and electronic applications, tungsten-copper composites are often employed owing to their high wear resistance and superior thermal and electrical properties.

For the production of composite materials, in particular tungsten-copper composites, various processes are known. These processes, however, have their limitations in the aspects of quality of composites produced, process speed and economic considerations.

Composite materials consist of two phases—a matrix phase which is continuous and surrounds the other phase often known as a dispersed phase. For example, in the context of tungsten-copper composites, tungsten forms the matrix phase and copper forms the dispersed phase within the tungsten matrix. The quality of the composite material is determined by its homogeneity and porosity, i.e., even distribution of copper throughout the tungsten-copper composite and low percentage of voids formed.

Composites are multiphase materials that exhibit a significant proportion of the properties of both constituent phases such that a better combination of properties is realized. Therefore, a uniform distribution of the two phases throughout the composite is required to ensure homogeneous material properties.

Porosity is deleterious to flexural strength, electrical and thermal conductivity of the composite. The presence of pores in the composite structure reduces the cross-sectional area across which a load is applied and they also act as points of stress concentrations, thus resulting in an exponential decrease in flexural strength. Air that is present in the pores has poor thermal and electrical conductivity, and thus affects the overall thermal and electrical properties of the composite. Therefore, it is desirable to minimize formation of pores in the composite during its manufacturing process.

Present manufacturing technologies available for producing metal or metal-ceramic composite materials, in particular tungsten-copper composites, include powder metallurgy compacting, covering and infiltration (also known as sinter casting), powder metallurgy compacting, covering and infiltration under pressure (also known as pressure casting), powder injection molding, covering and infiltration, and powder injection molding of a composite feedstock.

In powder metallurgy compacting, covering and infiltration, a first metal matrix or ceramic/carbide matrix, having a higher melting point and having a network of interconnected pores, is produced by powder metallurgy compacting, which fabricates the matrix by compacting a metal or ceramic/carbide powder into a mold under high pressure and then sintering the compacted powder to form the matrix. Solid plates of a second metal, having a lower melting point, are placed on the surface of the matrix to cover it, and are melted under a high temperature to enable infiltration of the second metal by capillary action into the matrix to fill up the pores. The metal filled pores form the dispersed phase. However, the matrix produced by powder metallurgy compacting has an uneven distribution of pores which results in a non-uniform distribution of the dispersed phase in the composite.

In powder metallurgy compacting, covering and infiltration under pressure (also known as pressure casting), a first metal matrix or first ceramic/carbide matrix, having a higher melting point and having a network of interconnected pores, is produced by powder metallurgy compacting. A second metal, having a lower melting point and in a liquid state, is placed in a mold with the matrix. This is followed by infiltration of the second metal into the pores of the matrix by means of an external applied pressure. Yet again, the matrix resulting from powder metallurgy compacting has an uneven distribution of pores which results in a non-uniform distribution of the dispersed phase in the composite. Further, the use of an applied pressure substantially increases manufacturing costs.

In powder injection molding, covering and infiltration, a first metal matrix or first ceramic/carbide matrix, having a higher melting point and having a network of interconnected pores, is produced by powder injection molding (PIM). In PIM, the matrix is fabricated by injecting a PIM feedstock, the PIM feedstock comprising a metal or ceramic/carbide powder and binder, into a mold where it is cooled and then ejected therefrom. The binder is removed from the ejected material, which is then sintered to form the matrix. Solid plates of a second metal, having a lower melting point, are placed on the surface of the matrix. Infiltration of the second metal into the matrix is completed by capillary force action under high temperatures. This method has an advantage in that it results in a composite material with a more even distribution of the dispersed phase within the matrix. However, this method is only suitable for producing composites that are of a simple geometry and is not suitable for producing composite components with complicated shapes. Further, the method involves separately providing a metal plate on the surface of the matrix for infiltration to take place.

In powder injection molding of composite powders, the composite powder is a mixture of metal/ceramic/carbide powder with binders, which is known as the PIM feedstock. This process fabricates the composite component by first injecting a heated PIM feedstock into a mold where it is cooled and from which it is then ejected. This is followed by removing the binder from the ejected material, and then sintering the material to form the composite component. This method, although achieved in a single process, is limited in its inability to produce composite components that have a high composition of the dispersed phase. For example, in the context of tungsten-copper composites, composites with 20–30 weight % of copper are very difficult to produce by this method, owing to the large density difference between tungsten and copper, as well as the lack of tungsten to tungsten particle interlocking. This causes copper to bleed out during sintering which leads to loss of copper and defects in the composite component such as formation of voids in its microstructure.

U.S. Pat. No. 5,963,773, issued on 5 Oct. 1999, to Yoo, et al., discloses a method of fabrication of a tungsten skeleton structure comprising the steps of forming a source powder by coating a tungsten powder surface with nickel, forming an admixture by admixing the source powder and a polymer binder, performing powder injection molding and obtaining a tungsten skeleton structure by removing the polymer binder. A copper plate is then placed beneath the tungsten skeleton structure and copper infiltration is carried out at a temperature between 1150° C. and 1250° C. within a hydrogen atmosphere for 2 hours. However, the method involves separately providing a copper plate beneath the tungsten skeleton structure for copper infiltration to take place. Further, this method is not viable or too troublesome for producing components with complicated shapes.

U.S. Pat. No. 5,574,959, issued on 12 Nov. 1996, to Tsujioka, et al., relates to a process for manufacturing composites comprising the steps of mixing tungsten powder and nickel powder to form a mixed metal powder, kneading the mixed metal powder with an organic binder to form an admixture, injection molding the admixture to form a predetermined shape, removing the binder from the shaped material, and applying a surface powder to at least one surface of the shaped material to prevent effusion of copper during sintering. The shaped material is then placed on a plate of solid copper and placed in a sintering oven where the copper melts and infiltrates into the shaped material. However, this method also involves separately providing a copper plate beneath the shaped material for copper infiltration to take place and is not viable or too time consuming for producing components with complicated shapes.

U.S. Pat. No. 5,413,751, issued on 9 May 1995, to Polese, et al., describes a process for forming heats sinks and other heat dissipating elements by press-forming composite powders of metal components, for example tungsten and copper, to form pressed compacts and then sintering the pressed compacts to achieve a homogeneous distribution of the copper throughout the tungsten-copper composite structure. However, the use of an external pressure to compact the composite powders leads to substantial increase in manufacturing costs.

At least some of the above processes might usefully be improved upon.

SUMMARY OF THE INVENTION

An aspect of the present invention provides a method of producing a composite material having a matrix phase and a dispersed phase. The method comprises compacting a matrix powder feedstock to form a matrix component, the matrix powder feedstock comprising a powder of a matrix phase material mixed with a first binder; and molding an infiltrant powder feedstock onto a surface of the matrix component, the infiltrant powder feedstock comprising a powder of a dispersed phase material mixed with a second binder, to form an infiltrant layer thereby forming a composite system of the matrix component and the infiltrant layer. The binders from the composite system are removed. The composite system is sintered, thereby coalescing the matrix component into the matrix phase having a network of interconnected pores, and causing infiltration of the infiltrant layer into the pores of the matrix phase to form the dispersed phase.

A further aspect of the invention provides a composite material made in this manner.

BRIEF DESCRIPTION OF THE DRAWINGS

These and other features, aspects and advantages of the present invention will become better understood from the following description of non-limiting examples with reference to the accompanying drawings, where.

DETAILED DESCRIPTION OF THE PRESENT INVENTION

Figure 1:
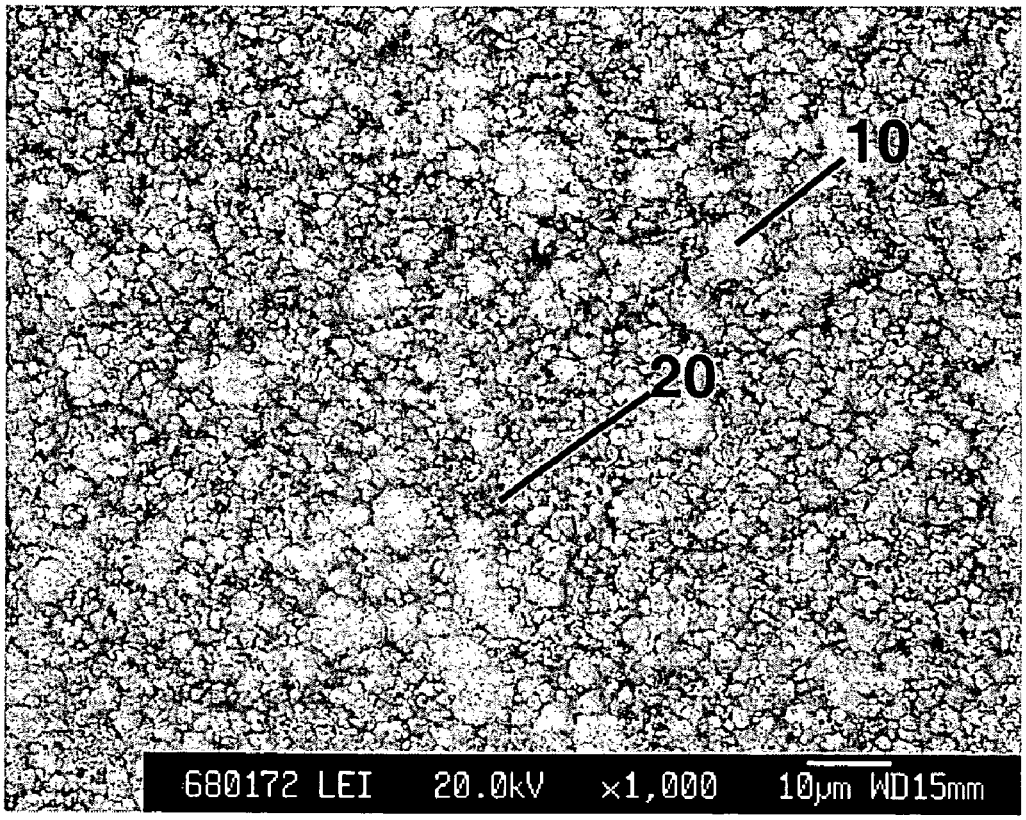
FIG. 1 is a SEM micrograph of 1000× magnification of the morphology of a tungsten-copper composite material prepared in accordance with an embodiment of the present invention.

The exemplary embodiments relate to the fabrication of metal-metal or metal-ceramic/carbide composite materials by powder injection molding and infiltration. This is achieved by first forming a composite system having a matrix component and an infiltrant layer. The matrix component is formed from a metal or ceramic/carbide powder, that is of a higher melting point, admixed with a first binder. The infiltrant layer is formed from a metal powder, that is of a lower melting point, admixed with a second binder. The first and second binders are subsequently removed from the composite system during a debinding process. The composite system is then heated in a sintering furnace to coalesce the matrix component into a matrix phase having a network of interconnected pores, and to effect infiltration of the infiltrant layer into these pores to form the composite material of the present invention.

In a first embodiment of a method according to the present invention, powder of a metal-metal or metal-ceramic/carbide matrix phase material is mixed with a first binder to form a matrix PIM feedstock, and powder of a metal dispersed phase material is mixed with a second binder to form an infiltrant PIM feedstock. Using one barrel of a double barrel powder injection molding apparatus, the matrix PIM feedstock is heated and injected into a mold to form the matrix component. Once the matrix component has solidified sufficiently, part of the mold is shifted away from it to leave a gap. The infiltrant PIM feedstock is then heated and injected into that gap using the other barrel of the machine. Thus it is molded onto a surface of the matrix component to form an infiltrant layer. The infiltrant powder feedstock is powder injection molded onto one or more predetermined locations of the surface of the matrix component. The matrix component and the infiltrant layer form a composite system, which is then cooled and ejected from the mold. A debinding process then follows to remove the binders that were initially mixed with the matrix phase material powder and the dispersed phase material powder. Subsequently, the composite system with the binders removed undergoes sintering to form the composite material of the present invention. During sintering, the matrix component is coalesced into a solid matrix structure having a uniform network of interconnected pores. The high temperature of the sintering process also results in the infiltrant layer melting and infiltrating into the matrix structure to fill up the pores to form the dispersed phase, thus forming a composite material that has an almost 100% dense microstructure, i.e., negligible porosity.

In a second exemplary embodiment of the present invention, the matrix PIM feedstock and the infiltrant PIM feedstock are prepared as in the first embodiment. Using one barrel of a double barrel powder injection molding apparatus, the matrix PIM feedstock is heated and injected into a mold to form a matrix component. The mold is then opened, and a surface of the matrix component is spray coated with a film of wax solution by means of a spraying can or other spraying device. The mold is closed up again, with a gap between the moving part of the mold and the matrix component and the infiltrant PIM feedstock is then heated and molded onto the wax film on the matrix component using the other barrel of the machine to form an infiltrant layer. The infiltrant powder feedstock is powder injection molded onto one or more predetermined locations of the surface of the matrix component.

The infiltrant layer, film of wax, and the matrix component form a composite/wax system which is subsequently cooled and ejected from the mold. This is followed by a debinding process to remove the film of wax and the binders that were initially mixed with the matrix phase material powder and the dispersed phase material powder. The composite/wax system, with the wax and the binders removed, then undergoes sintering to form the composite material of the present invention. During sintering, the matrix component is coalesced into a solid matrix structure having a network of interconnected pores. The high temperature of the sintering process also results in the infiltrant layer melting and infiltrating into the matrix structure to fill up the pores and forming the dispersed phase, thus forming a composite material that has an almost 100% dense microstructure or negligible porosity.

The film of wax minimizes or eliminates dimensional distortions of the composite material by catering for small thermal expansion differences between the matrix component and the infiltrant layer during debinding. During solvent debinding, the film of wax is dissolved into the solvent, thereby creating pockets of space between the matrix component and infiltrant layer. The pockets of space allow a certain degree of expansion between the matrix component and the infiltrant layer so that dimensional distortions of the composite material are minimized or eliminated.

In accordance with the preferred embodiments of the present invention, any one of a multiplicity of matrix phase materials can be employed. These materials, for example, are powders of metal from the group consisting of tungsten (W), iron (Fe), molybdenum (Mo), tantalum (Ta), and combinations thereof, and powders of ceramics from the group consisting of tungsten carbide (WC), silicon carbide (SiC), and combinations thereof.

In accordance with the preferred embodiments of the present invention, any one of an assortment of dispersed phase materials can also be employed. These materials, for example, are powders of metal from the group consisting of copper (Cu), nickel (Ni), cobalt (Co), and combinations thereof.

In accordance with the preferred embodiments of the present invention, the optimal solid volume loading of the infiltrant PIM feedstock onto the matrix component is predetermined through experimental trial and error. The volume loading of the infiltrant powder feedstock which results in the smallest difference in shrinkage between the matrix component and the infiltrant layer at the debinding temperature range is the optimal loading.

The binders used in the embodiments of the present invention are generally wax-based binders that are known to a person skilled in the art, for instance polypropylene wax or any thermoplastic or gelling binder comprising a principal constituent (e.g. paraffin, polyethylene wax, beeswax, etc.), thermoplastic (e.g., polyethylene, polypropylene, polystyrene, etc.) and additives (e.g., stearic acid, oleic acid, phthalic acid esters, etc.). More preferably, the binder used is a commercial binder comprising 50 weight % polypropylene, 45 weight % paraffin wax, 3 weight % stearic acid and 2 weight % carnauba wax. The binders in the matrix PIM feedstock and the infiltrant PIM feedstock can be the same or different. The addition of the binders serves to hold the powders of the matrix phase material or the powders of the dispersed phase material together prior to the sintering process. The binder in the matrix component, through its removal in the debinding process, creates the pores in the matrix component to be filled by the infiltrant layer.

The debinding process according to the embodiments of the present invention is preferably a combination of solvent debinding and thermal debinding. Solvent debinding reduces potential dimensional distortion due to thermal expansion/contraction of the composite or composite/wax system. It is therefore combined with thermal debinding to minimize dimensional distortions that may result from thermal debinding alone. Other debinding processes that can be employed include thermal debinding, solvent debinding, catalytic debinding (if catalytic binders are used) or combinations thereof.

In the method according to the second embodiment of the present invention, the film of wax can be paraffin wax, polyethylene wax, beeswax or any combination thereof.

EXAMPLE

Tungsten-Copper Composite

In order to carry out double barrel powder injection molding, tungsten and copper PIM feedstocks were manufactured.

The tungsten PIM feedstock was formed by mixing tungsten powder (particle size 50 nm–1000 nm, and purity 99.9%) with a commercial binder comprising 50 weight % polypropylene, 45 weight % paraffin wax, 3 weight % stearic acid and 2 weight % carnauba wax for 1 hour at a temperature of 160° C. The solid volume loading of the tungsten PIM feedstock is about 38 to 55 percent. Similarly, the copper PIM feedstock was formed by mixing copper powder (particle size 10 μm (micron)-50 μm (micron) and purity 99%) with the binder for 1 hour at a temperature of 160° C. The solid volume loading of the copper PIM feedstock is about 45 to 60 percent.

The tungsten PIM feedstock was injected at a nozzle temperature of 170° C. and a pressure of 800 bar into a mold to form a tungsten matrix tensile bar. The mold was then opened, and a film of paraffin wax was then spray coated onto a surface of the tungsten matrix tensile bar. The film was of a thickness in the range of 10 to 300 microns. The mold was closed up again, and part of the mold was shifted away from it to leave a gap. The copper PIM feedstock was then injected at a nozzle temperature of 170° C. and a pressure of 800 bar onto the wax film to form a copper infiltrant layer. The tungsten matrix tensile bar, film of paraffin wax, and the copper infiltrant layer formed the tungsten-copper (W—Cu) composite system which was then cooled and ejected from the mold.

Part of the binder and paraffin wax of the W—Cu composite system was removed by solvent debinding at a temperature of 70° C. for 4 hours. The remaining binder and wax were entirely removed by thermal debinding at a heating rate of 3° C./min up to 900° C. and then holding at 900° C. for about 1 hour. The purpose of solvent debinding is to remove portions of the binders selectively at relative low temperature to create tiny channels for easy thermal debinding. Without solvent debinding, thermal debinding alone would take a long time which could lead to debinding defects.

The resulting W—Cu composite system was then placed in a sintering oven where it was sintered at a temperature of 1250° C. for 150 minutes, and then at a temperature of 1060° C. for 60 minutes, thereby obtaining a final W—Cu composite material.

The time for which solvent debinding was carried out need not be fixed at 4 hours and could typically be in the range of from 1 to 6 hours. Typical conditions for sintering could be at a temperature of 1090° C. to 1350° C. for 30 to 300 minutes followed by cooling down to a temperature range of 800° C. to 1080° C. and holding there for 30 to 150 minutes.

Cu has a melting point of 1086° C. Sintering at the temperature of 1250° C. or a temperature range of 1090° C. to 1350° C. for 30 to 300 minutes ensures complete infiltration of the Cu into the W matrix tensile bar. Further, holding during the cooling cycle at a lower temperature range of 800° C. to 1080° C. for 30 to 150 minutes ensures that defects in the composite material are minimized during Cu solidification.

As the Cu is infiltrated into the W skeleton during sintering, the amount of Cu used is normally more than the actually required. The ratio of the volume of the PIM W feedstock to PIM Cu feedstock is about 1 to 1. There is some extra Cu left after infiltration, but any remainder Cu is readily removed after sintering (normally extra Cu automatically drops off from the surface of the body after sintering).

Figure 2:
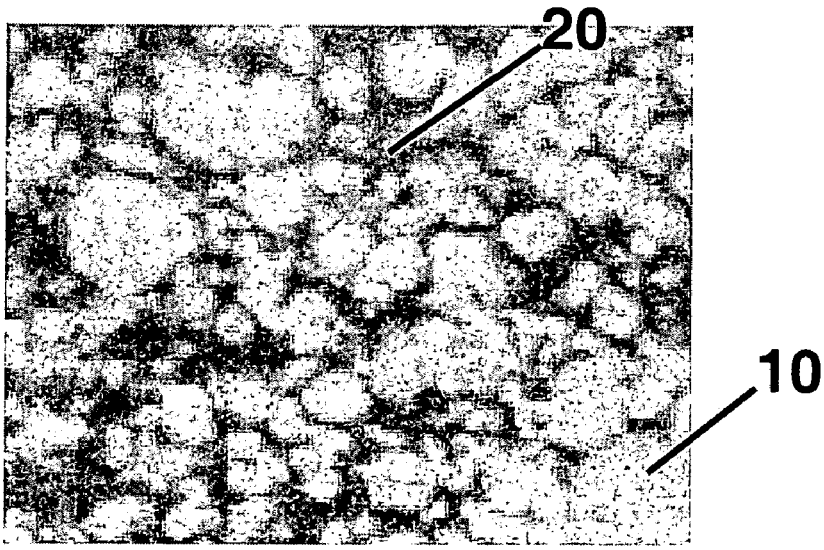
FIG. 2 is a view of a portion of FIG. 1 that is further enlarged.

A SEM micrograph, of 1000× magnification, of the morphology of the W—Cu composite material produced is shown in FIG. 1. A further enlarged view of a portion of FIG. 1 appears in FIG. 2. The lighter areas 10 in FIGS. 1 and 2 are Tungsten (W), while the darker areas 20, in between the lighter areas in FIGS. 1 and 2 are copper (Cu). It is clear there are no other colored areas that would come from voids in the structure. The final W—Cu composite material had a composition of 33 weight % Cu, which was homogeneous throughout the W matrix.

An advantage of an embodiment of the present invention is that it is a combined process. Upon loading the double barrel injection molding machine with the matrix phase PIM feedstock and dispersed phase PIM feedstock, the process continues until the final composite is produced.

Another advantage of an embodiment of the present invention is that it does not utilize excessive external pressures, as in powder metallurgy compacting and in pressure casting which results in substantial increase in manufacturing costs.

Yet another advantage of an embodiment of this process is that composites with a higher percentage volume of a dispersed phase can be produced as compared to the existing manufacturing processes that involve the use of powder injection molding. For example, most existing technologies involving powder injection molding can manufacture tungsten-copper composites of up to 16 weight % only. The method of the present invention can produce tungsten-copper composites of 16–33 weight %.

Still another advantage of the present invention is that it can be used to manufacture composite components of a broader range of geometries including those that are complicated in shape.

It will be appreciated that the invention is not limited to the embodiments described herein and additional embodiments or various modifications may be derived from the application of the invention by a person skilled in the art without departing from the scope of the invention. For instance, whilst only two specific PIM feedstocks have been exemplified, almost any PIM feedstock presently being used could be used in other embodiments of his invention.

The invention claimed is:

1. A method of producing a composite material having a matrix phase and a dispersed phase, comprising:

powder injection molding a matrix powder feedstock to form a matrix component, the matrix powder feedstock comprising a powder of a matrix phase material mixed with a first binder;

powder injection molding an infiltrant powder feedstock onto a surface of the matrix component, the infiltrant powder feedstock comprising a powder of a dispersed phase material mixed with a second binder, to form an infiltrant layer, thereby forming a composite system of the matrix component and the infiltrant layer;

removing the binders from the composite system; and sintering the composite system, thereby coalescing the matrix component into the matrix phase having a network of interconnected pores, and causing infiltration of the infiltrant layer into the pores of the matrix phase to form the dispersed phase.

2. The method according to claim 1, further comprising coating a surface of the matrix component with wax solution prior to molding of the infiltrant powder feedstock onto the surface of the matrix component.

3. The method according to claim 1, wherein the infiltrant powder feedstock is powder injection molded onto one or more pre-determined locations of the surface of the matrix component.

4. The method according to claim 1, wherein the matrix phase material has a higher melting point than that of the dispersed phase material.

5. The method according to claim 1, wherein the first and second binders are the same.

6. The method according to claim 1, wherein the matrix phase material is selected from the group consisting of tungsten, tungsten carbide, silicon carbide, iron, and any combination thereof.

7. The method according to claim 1, wherein the dispersed phase material is selected from the group consisting of copper, nickel, cobalt and any combination thereof.

8. The method according to claim 7, wherein the infiltrant powder feedstock comprises a copper PIM feedstock, with a copper solid volume loading in the region from 45 to 60 percent.

9. The method according to claim 1, wherein the binder comprises 50 weight % polypropylene, 45 weight % paraffin wax, 3 weight % stearic acid and 2 weight % carnauba wax.

10. The method according to claim 1, wherein removing the binder from the composite system is achieved by solvent debinding.

11. The method according to claim 1, wherein removing the binder from the composite system is achieved by thermal debinding.

12. The method according to claim 1, wherein removing the binder from the composite system is achieved by a combination of solvent and thermal debinding.

13. The method according to claim 1, wherein the amount of infiltrant powder feedstock molded onto the surface of the matrix layer is pre-selected.

14. The method according to claim 10, further comprising pre-selecting said amount of infiltrant powder feedstock which results in the smallest difference in shrinkage between the matrix component and the infiltrant layer at the debinding temperature range.

15. The method according to claim 1, wherein molding the matrix powder feedstock and the infiltrant powder feedstock are performed using a double barrel injection molding apparatus.

16. A composite material having a matrix phase and a dispersed phase, produced by a method comprising:

powder injection molding a matrix powder feedstock to form a matrix component, the matrix powder feedstock comprising a powder of a matrix phase material mixed with a first binder;

powder injection molding an infiltrant powder feedstock onto a surface of the matrix component, the infiltrant powder feedstock comprising a powder of a dispersed phase material mixed with a second binder, to form an infiltrant layer, thereby forming a composite system of the matrix component and the infiltrant layer;

removing the binders from the composite system; and sintering the composite system, thereby coalescing the matrix component into the matrix phase having a network of interconnected pores, and causing infiltration of the infiltrant layer into the pores of the matrix phase to form the dispersed phase.

* * * * *

UNITED STATES PATENT AND TRADEMARK OFFICE

CERTIFICATE OF CORRECTION

PATENT NO. : 7,063,815 B2
APPLICATION NO. : 10/729429
DATED : June 20, 2006
INVENTOR(S) : Li et al.

It is certified that error appears in the above-identified patent and that said Letters Patent is hereby corrected as shown below:

Column 7, Line 27; (Application Page 5, Line 2);
"heats" should be --heat--;

Column 7, Line 21 (Application Page 11, Line 14);
After "than" delete "the";

Column 7, Line 67 (Application Page 12, Line 19);
"his" should be --this--;

Column 9-10, Line 1-10, Claim 16 (Supplemental Notice of Allowability dated 5/8/06 Page 2, Line 6-9, CLaim 7);
Delete Claim 16 of patent (original Claim 17) and insert original Claim 7:
--The method according to claim 6, wherein the matrix powder feedstock comprises a tungsten PIM feedstock, with a tungsten solid volume loading in the region from 38 to 55 percent.--.

Signed and Sealed this

Twenty-ninth Day of May, 2007

JON W. DUDAS
*Director of the United States Patent and Trademark Office*